United States Patent [19]

Bahry et al.

[11] Patent Number: 4,548,058

[45] Date of Patent: Oct. 22, 1985

[54] PROTECTIVE HASPS FOR A PADLOCK

[76] Inventors: Avraham Bahry; Moshe Dolev, both of c/o Rav Bariach Ltd., P.O. Box 465, Yavne, Israel

[21] Appl. No.: 444,483

[22] Filed: Nov. 24, 1982

[30] Foreign Application Priority Data

Nov. 25, 1981 [IL] Israel ..... 64355

[51] Int. Cl.[4] ..... E05B 67/30

[52] U.S. Cl. ..... 70/56; 70/417

[58] Field of Search ..... 70/54, 55, 56, 52, 375, 70/373, 374, 417

[56] References Cited

U.S. PATENT DOCUMENTS

| | | | |
|---|---|---|---|
| 234,630 | 11/1880 | Towne | 70/375 |
| 2,541,638 | 2/1951 | Clevett | 70/56 |
| 3,916,654 | 11/1975 | Mudge | 70/56 |

*Primary Examiner*—Robert L. Wolfe

*Attorney, Agent, or Firm*—McAulay, Fields, Fisher, Goldstein & Nissen

[57] ABSTRACT

Each side of a door opening, e.g., a hinged door and a jamb, or two sliding doors, is provided with a protective hasp for a lock body and shackle of a lock. Each half of the hasp is so formed that, when mated, as on joining of the doors or closing of the doors, provisions are made for insertion of a lock body into the protective hasp, and insertion of a shackle through the hasp and the lock body to lock the closure.

4 Claims, 6 Drawing Figures

PROTECTIVE HASPS FOR A PADLOCK

The present invention concerns a protective hasp for a padlock of the kind being used for swinging or sliding doors or gates.

For the purpose of the present invention the term "door" is to include wooden or metal swinging and sliding doors or gates which may be used within a wooden or metal door frame or between posts of a gate, hereinafter called collectively—jamb.

In order to lock a door by a padlock, a chain is required through the links of which the shackle is inserted, or alternatively, a hasp having an eyelet must be welded or screwed to the door and jamb so that the legs of the shackle can extend through said eyelets before being inserted into the body of the lock. Thus, on the one hand special means must be provided to attach the lock to the door, while with these means the padlock is generally exposed and can be broken open by the use of a crowbar, hammer, heavy cutter, welding torch and the like. There are known protected padlock assemblies, for example those described and claimed in U.S. Pat. Nos. 2,856,220; 744,280; 3,858,923 and 3,652,114. While these protectors enclose the entire padlock, they require separate hasps for attaching the padlock to the objects to be locked together. Other known shielded padlock assemblies, such as, for example, the one shown in U.S. Pat. No. 3,916,654 provide both a shield for the padlock and means for attaching it, but both the shackle and the padlock body must be inserted from the bottom which is very cumbersome. For this reason, in the shielded lock assembly of U.S. Pat. No. 4,106,315, the shackle is fixedly welded in place so that only the padlock body has to be inserted from the bottom of the protector.

It is the object of the present invention to provide protective hasps for a padlock which completely encases the entire padlock and furthermore constitutes the means for attaching the padlock to the door and jamb.

The invention consists in a protective hasp for a padlock comprising two complementary shells, which when abutting each other enclose the entire padlock, each of said shells having an opening from the top for the insertion of one leg of the shackle, and a larger opening from the bottom to house the lock body when the shells abut against each other, the said shells providing the attachment means for said padlock on the door and jamb, as hereinbefore defined.

In a preferred embodiment of the invention, the sides of the shells which abut each other have a profile of interengaging teeth.

The invention is illustrated, by way of example only, in the accompanying drawings in which.

Figure 2:
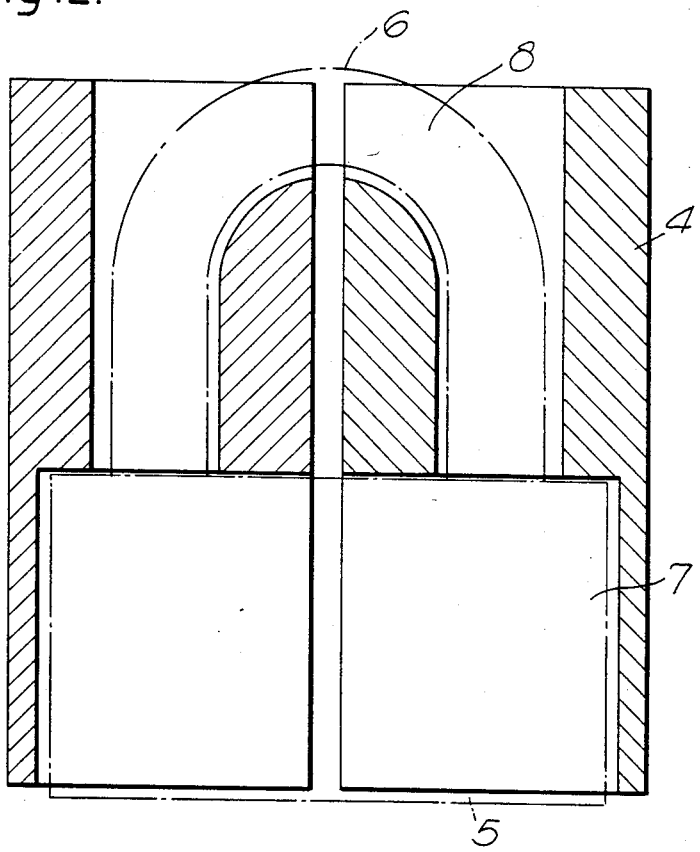
FIG. 2 is a vertical section of said hasp on a larger scale showing the padlock in dash-dotted lines.

A swinging door 1 which is mounted between two jambs 2 is provided at its edge remote from the hinges with a padlock and a hasp therefor, generally referenced by 3. As can be seen in FIG. 2, said hasp is made of two complementary shells 4 one of which is fastened to door 1 and the other to jamb 2. Said shells are here shown of a height to cover the entire padlock 5 indicated in dash-dotted lines, but they may also be of a length to cover the shackle 6 only when it is inserted into the body of the padlock 5.

Figure 3:
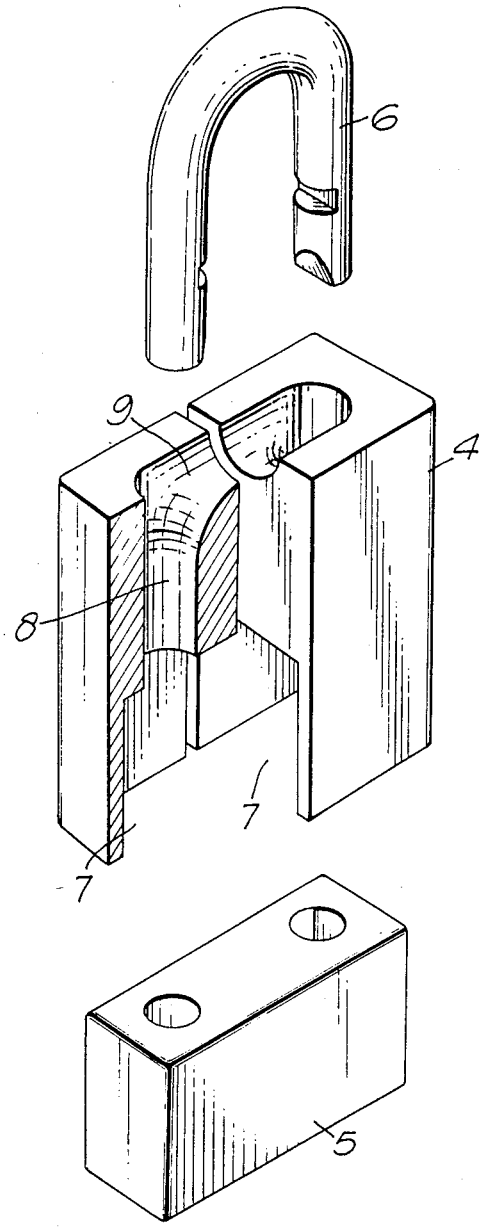
FIG. 3 is a perspective exploded view partially in section of a padlock and protective hasp.

The shells may or may not be identical with each other and comprise a cut-out 7 at the bottom to cover the body of the padlock and at the top are provided with a channel 8. Said channel is cylindrical for most of its length leading at the bottom into cut-out 7, and at the top has a transverse part 9 which is curved internally as can be seen in FIGS. 2 and 3, so that it can house substantially half the shackle 6. The vertical adjacent edges of the shells are straight. When door 1 is closed so that its vertical edge lies adjacent post 2, the shells complement each other to provide in their bottom the space for lock 5. The shackle 6 can be inserted in channels 8 from the top and pressed into lock part 5 to be closed.

The protective hasp serves both as a protection for the entire lock and as a means to attach the lock to the door and jamb. As can be clearly understood it is immaterial whether door 1 is a sliding door or a swinging door or a rolling shutter.

Figure 1:
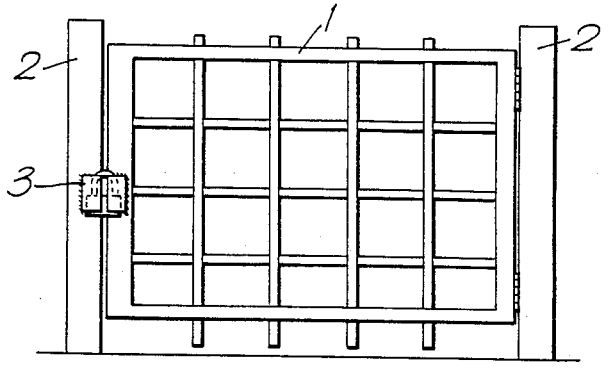
FIG. 1 is an elevation of a swinging door provided with a protective hasp for a padlock according to the invention.
Figure 6:
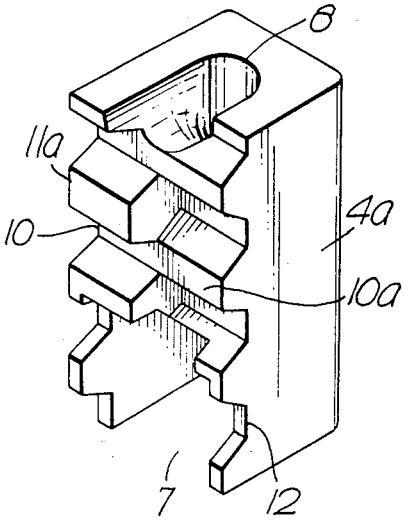
FIG. 6 is a perspective view of one of the shells of the hasp.
Figure 4:
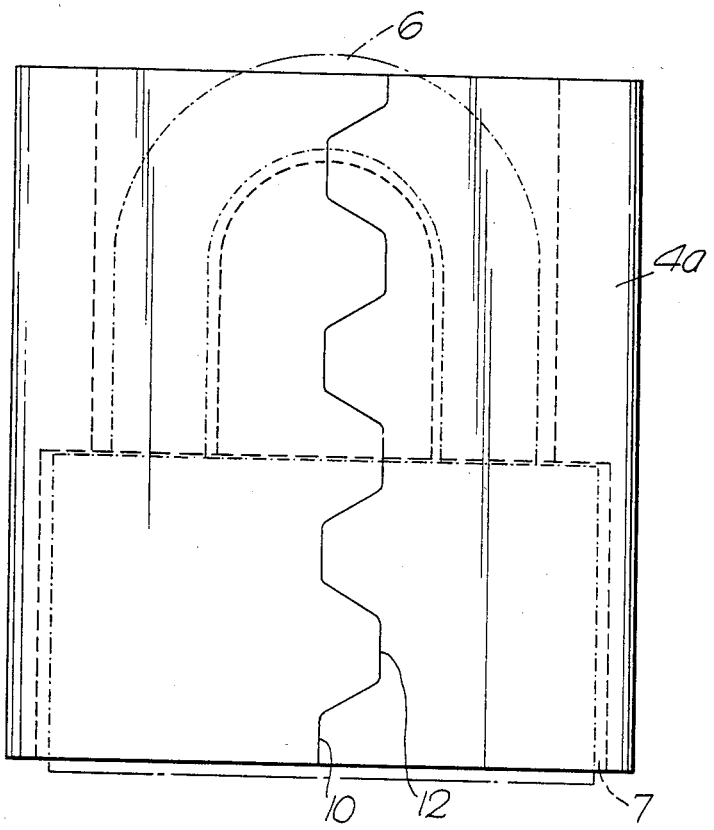
FIGS. 4 and 5 are, respectively, an elevation and a plan view of a second embodiment of the protective hasp for the padlock according to the invention.
Figure 5:
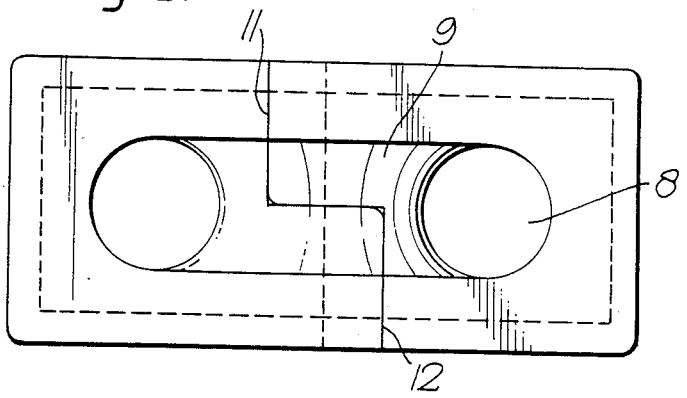

In the embodiment of the hasp shown in FIGS. 4 and 5 and 6, the parts which are the same as these of FIGS. 1–3 are referenced with the same numerals. The vertical abutting walls of the shells **4*a* are provided here with a toothed profile in such a manner that the flat root 10 of the teeth 11 on one side of the longitudinal median plane of one shell, constitutes the flat crest 10*a* of the teeth on the other side of said plane. The flat root 12 lies between the crests 10*a* on said other side of said plane. Thus, when one of the shells is attached to the door 1 and one to the jamb 2**, the teeth of the shells interengage. This makes the tampering with the lock extremely difficult. Furthermore, the profiles of the interengaging teeth both on the swinging door and on a sliding door, centers the door relative the jamb.

It is, of course, understood that interengaging toothed profiles other than that illustrated and described is within the scope of the present invention with the same advantages.

It can be seen that a further advantage of these hasps over the conventional ones is the fact that the padlock and the shackles can be of a construction which is adapted for use with the hasps above described or with standard ones now on the market.

We claim:

1. A protective hasp for a padlock of the type having a lock body and a separable shackle having depending legs; said protective hasp comprising two complementary formed shells respectively adapted to be attached adjacent respective sides of a door opening; each of said shells when abutting each other having a bottom opening recess for receiving the lock body therein, and downwardly extending channels communicating with said recess and having top openings for receiving the shackle legs therethrough, whereby said channels encase said shackle legs to provide bearing surfaces therefor to lock said door.

2. A protective hasp as claimed in claim 1, wherein the abutting sides of the shells are straight.

3. A protective hasp as claimed in claim 1, wherein the abutting sides of the shells are provided with a toothed profile in such a manner that the teeth of one shell interengage with the teeth of the other.

4. A protective hasp as claimed in claim 2, wherein the abutting sides of the shells are provided with a toothed profile in such a manner that the teeth of one shell interengage with the teeth of the other.

* * * * *